US006616064B2

(12) United States Patent
Boecking

(10) Patent No.: US 6,616,064 B2
(45) Date of Patent: Sep. 9, 2003

(54) INJECTOR WITH A CONTROL FACE ON THE OUTLET SIDE

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/022,906

(22) Filed: Dec. 20, 2001

(65) Prior Publication Data

US 2002/0050532 A1 May 2, 2002

Related U.S. Application Data

(63) Continuation-in-part of application No. 09/893,576, filed on Jun. 29, 2001.

(30) Foreign Application Priority Data

Jun. 29, 2000 (DE) ..... 100 31 572

(51) Int. Cl.[7] ..... F02M 41/16
(52) U.S. Cl. ..... 239/96; 239/88; 239/91
(58) Field of Search ..... 239/88–92, 95, 239/96, 124–127, 533.2–533.5, 585.1–585.5; 123/457, 459; 251/30.05, 37, 43

(56) References Cited

U.S. PATENT DOCUMENTS 4,211,202 A * 7/1980 Hafner ..... 239/96
4,745,898 A * 5/1988 Egler et al. ..... 123/300
5,524,826 A * 6/1996 Mueller et al. ..... 239/88
5,984,200 A * 11/1999 Augustin ..... 239/88
6,029,632 A * 2/2000 Augustin ..... 123/467

* cited by examiner

*Primary Examiner*—Micheal Powell Buiz
*Assistant Examiner*—Dinh Q. Nguyen
(74) *Attorney, Agent, or Firm*—Ronald E. Greigg

(57) ABSTRACT

The invention relates to an injector with a valve chamber which is contained in an injector housing and can be loaded by way of an inlet from the high-pressure accumulation chamber. This valve chamber loads a nozzle inlet to an injection nozzle by means of a control element that can be moved in the injector housing upon the pressure relief of a control chamber. On the control element, which is embodied of one part or multiple parts, a control surface is disposed in the pressure relief region of the nozzle inlet.

9 Claims, 1 Drawing Sheet

Fig. 1
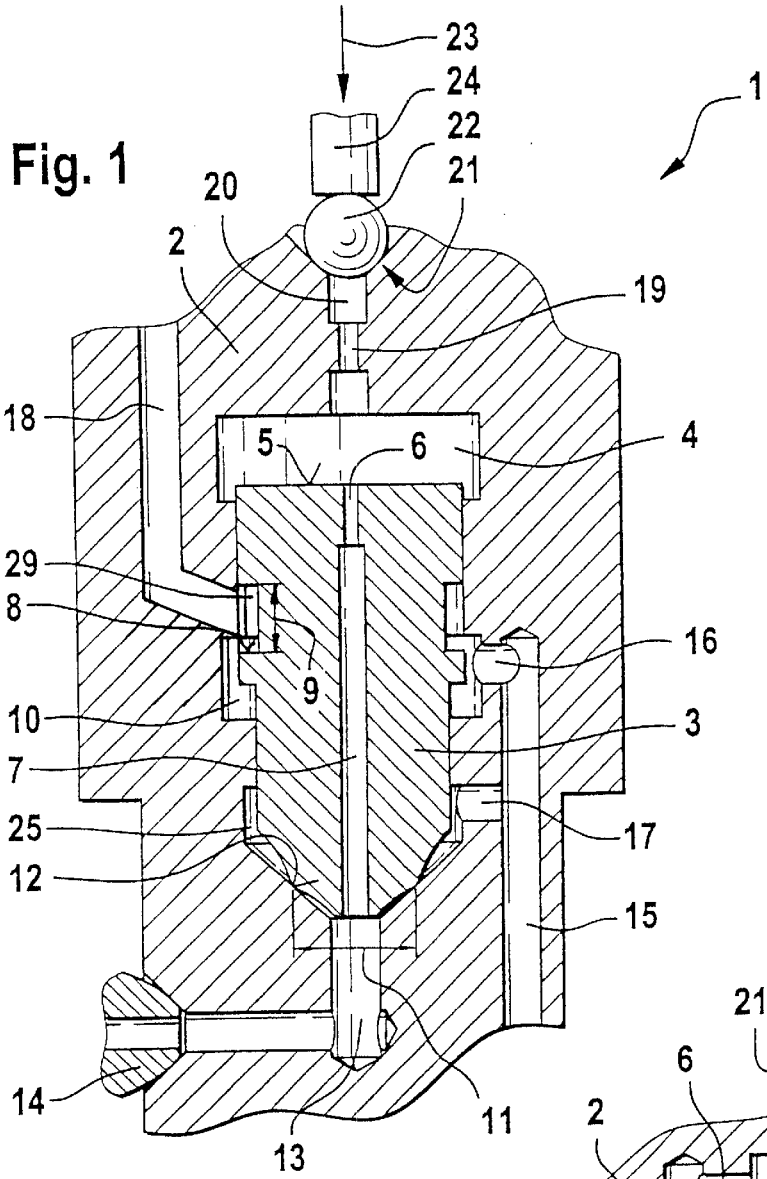
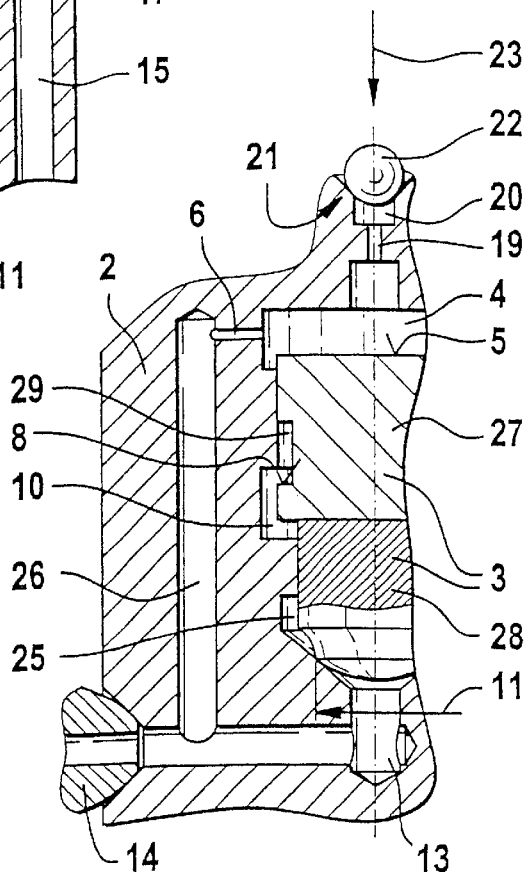
Fig. 2

INJECTOR WITH A CONTROL FACE ON THE OUTLET SIDE

This application is a Continuation-In-Part of U.S. patent application Ser. No. 09/893,576, filed Jun. 29, 2001.

BACKGROUND OF THE INVENTION

1. Field of the Invention

In the case of injectors for injecting highly pressurized fuel into combustion chambers of internal combustion engines, control elements are generally used that contain multiple stepped pistons. In these configurations, the control surface is always larger than the valve seat at which a valve chamber is sealed off from the nozzle inlet of the injection nozzle. The processing of control element pistons embodied as stepped is always laborious and therefore cost-intensive. It is difficult to achieve the exact coaxial embodiment of stepped surfaces partly used as sealing seats.

2. Description of the Prior Art

DE 37 28 817 C2 relates to a fuel injection pump for an internal combustion engine. A control valve member is comprised of a valve shaft, which constitutes a guide bush and slides in a channel, and a valve head, which is connected to the valve shaft and is oriented toward an actuation device. The valve surface of the valve head cooperates with the surface of the control bore forming the valve seat. The valve shaft has a recess on its circumference whose axial span extends from the inlet of the fuel supply line to the beginning of the sealing surface which is disposed on the valve head and cooperates with the valve seat. In the recess, a surface is embodied which is subjected to the pressure of the fuel supply line and whose surface area is equal to that of a surface of the valve head that is subjected to the pressure of the fuel supply line when the control valve is closed. As a result, the valve is pressure-compensated when it is closed. The guide bush contains a spring that loads the control valve in the direction of its open position. In this embodiment, many parts are required for controlling the control valve, which parts move in relation to one another and must move in relation to one another with a high degree of precision.

SUMMARY OF THE INVENTION

In the embodiment of a control element as a valve that is struck by the flow centrally, which is proposed according to the invention, a particularly simple embodiment can be achieved. The processing of a one-piece valve extending essentially in the vertical direction is very simple to achieve from a production technology standpoint. The control valve can, for example, be provided with a central through bore whose end nearest the control chamber has an inlet throttle to the control chamber embodied in it. It is also possible to embody a leakage oil control groove on the circumference of the control element, which is struck by the flow centrally, with the leakage oil control groove running essentially in the circumferential direction. An end face of the leakage oil control groove embodied on the control element on the leakage oil side can be embodied as a control surface with a larger diameter compared to the diameter of the control element, which is subjected to the prevailing pressure from the high-pressure accumulation chamber. Consequently, a one-piece control element which is essentially embodied as a turned part on its outer surface and as a drilled part on the inside can reduce the number of working steps required for its manufacture. Through advantageous disposition and utilization of the leakage oil control groove as a control surface for the closing during the closing process of the valve, in a hollow annular chamber encompassing the one-piece control element, it is possible on the one hand to dispose the nozzle discharge at the closing of the valve, and it is possible on the other hand to provide the leakage oil discharge line at the opposite end of the annular chamber.

The control chamber, which can be simply embodied at the upper end of the control element, can be actuated by way of a separately actuatable closing element and is defined by an end face of the control element containing the inlet throttle and is otherwise defined by the walls of the injector housing.

On the lower end of the control element, which can be produced in a very light-weight and simple fashion from a production technology standpoint, a conically configured valve seat is embodied, which can be struck centrally by the flow from the high-pressure accumulation chamber. The valve chamber, which is defined on one side by a correspondingly rounded housing wall and on the other side by a conically configured outer surface of the control element, empties into a nozzle inlet by way of a transverse bore. Originating from the high pressure accumulation chamber inlet by way of the nozzle inlet, a nozzle chamber encompassing a nozzle needle can be loaded with fuel that is under extremely high pressure.

If the control element is embodied of one piece, on the one hand, the leakage oil chamber provided downstream can provide for a rapid discharge of the nozzle inlet and on the other hand, the control surface is embodied in the vicinity of the leakage oil control chamber, which permits a rapid closing of the valve while, at the same time, relieving the pressure of the nozzle inlet. In an advantageous embodiment of the concept underlying the invention, this control surface can be embodied as a simple collar with a leakage oil control groove of a corresponding length extending on it in the axial direction toward the control chamber.

Besides a through bore being provided in a one-piece control element and extending coaxially to the symmetrical line of the control part, this through bore can also be shifted into the injector housing. If the through bore, on whose end an inlet throttle into the control chamber can be provided, is embodied in the injector housing, the control element can be produced from two separate parts. The production of the control element from two valve bodies resting against each other offers advantages from a production technology standpoint with regard to material selection because only the part of the valve body oriented toward the high-pressure accumulation chamber inlet needs to be made of high-strength material. The valve body provided on the downstream end can comprised of material which is easier to process and less expensive. The embodiment of the control element in two separate valve bodies that are independent of each other offers the advantage of greater ease in manufacturing due to the fact that standardized production processes can be performed on numerically controlled processing machines and the valve bodies have a geometry with a low level of complexity that is suitable for numerically controlled processing machines.

BRIEF DESCRIPTION OF THE DRAWINGS

The invention will be explained in detail below with reference to the drawings, in which:

FIG. 1 shows a longitudinal section through an injector housing of an injector with a control element embodied of one piece, penetrated by a through bore with an inlet throttle on the side oriented toward the control chamber, and FIG. 2 shows an injector housing in which the control element is comprised of two valve bodies disposed apart from each other, where a bore is provided in the injector housing and has an inlet throttle for acting on the control chamber with a control volume.

DESCRIPTION OF THE PREFERRED EMBODIMENTS

The depiction according to FIG. 1 shows a longitudinal section through an injector with an injector housing in which a one-piece control element is embodied, which can be moved in the vertical direction.

The injector 1 proposed according to the invention includes a housing 2 which contains a control element 3 embodied in one piece in accordance with the depiction of FIG. 1. The control element 3 can be moved up and down in the vertical direction in the housing 2 of the injector 1 and, by means of its valve seat diameter, closes off the inlet from the high-pressure accumulation chamber (common rail) to the nozzle inlet for an injection nozzle. Above the one-piece control element 3, a control chamber 4 is provided that is defined by the wall of the housing 2 of the injector 1 on one side and whose other limit is provided by an end face 5 embodied on the one-piece control element 3.

Viewed in the vertical direction, the one-piece control element 3 is penetrated by a through bore 7 which, in its upper region, contains an inlet throttle 6 that empties into the control chamber 4 provided above the end face 5 of the control element 3. The through bore 7 and throttle 6 connect the connection 14 of the high-pressure accumulation chamber by way of the high-pressure accumulation chamber inlet to the control chamber 4 in the housing 2 of the injector 1 in such a way that the control chamber 4 is assured of being constantly loaded by a control volume of highly pressurized fuel.

Approximately in the middle with regard to the entire axial span of the one-piece control element 3, it is encompassed by a leakage oil chamber 10 that extends in an annular fashion. An upper transverse bore 16 that is connected to a nozzle inlet 15 extends from the leakage oil chamber 10 on one side. On the side opposite bore 16, an inclined bore connects the central bore of housing 2, at a location above and adjacent to the leakage oil chamber 10 to the leakage oil line 18, which returns the fuel in the leakage oil chamber 10 back to the supply tank of the motor vehicle. In the region of the annular leakage oil chamber 10 embodied in the housing 2 of the injector 1, a leakage oil control groove 29 is embodied on the one-piece control element 3, which groove can be embodied, for example, as a recess extending in an annular fashion around this leakage oil chamber. In the axial direction, the recess has a span 9 that corresponds approximately to the axial span of the annular leakage oil chamber 10. A control surface—provided with the reference number 8—is embodied on the leakage oil control groove, by way of which the control element can be closed against the seat diameter 11 by contacting the seat face 12 embodied in the housing 2 of the injector 1. In the lower region of the control element 3, a valve chamber 25 is embodied in the housing 2 of the injector 1, from which valve chamber a transverse bore 17 empties into the nozzle inlet 15, from which highly pressurized fuel flows to the injection nozzle and/or to a nozzle chamber disposed upstream of this injection nozzle. The seat face 12 is embodied in the valve chamber 25 of the housing 2 and closes off the valve chamber 25 when the one-piece control element 3 moves vertically downward, so that no more fuel can flow into the valve chamber 25 by way of the high-pressure accumulation chamber connection 14 and the high-pressure accumulation chamber inlet 13 and the nozzle inlet 15 is thus sealed off.

In the upper region of the housing 2 of the injector 1, a valve actuation unit is provided that can be separately actuated. This valve actuation unit contains a spherically embodied closing element 22 that closes the sealing seat 21 of the closing element 22 in the working direction 23 of an actuator. In this manner, the control chamber 4 can be closed on the outlet side so that the high pressure continuously prevailing in this control chamber due to the inlet throttle 6 is not relieved. Only when the spherically embodied closing element 22 is raised by actuating the actuator counter to its working direction 23 does the closing element 22 move away from its sealing seat 21 so that a control volume can flow out of the control chamber 4 embodied in the upper region of the housing 2 by way of the outlet throttle 19.

An alternative disposition of the control element 3 can be seen in the depiction according to FIG. 2. In the depiction according to FIG. 2, the control element 3 encompassed by the housing 2 of the injector 1, is comprised of two parts, namely an upper part 27 of the control body and a lower part 28 of the control body. These control body parts rest against each other on flat surfaces inside the bore embodied in the housing 2 of the injector 1. The control surface 8 is formed in the upper control body part 27 and is embodied as a defining wall of a leakage oil groove, while the seat diameter 11 is embodied in the lower control body part 28 and can serve to seal the valve chamber 25 embodied in the lower region of the housing 2 from the high pressure prevailing on the high-pressure accumulation chamber 13. In the configuration according to FIG. 2, the control element 3, comprised of an upper control body part 27 and a lower control body part 28, is not penetrated by a central through bore 7. Rather, the through bore is provided as a lateral inlet 26 in the housing 2 of the injector 1. An inlet throttle element 6 is embodied at the entrance of the lateral inlet 26 into the control chamber 4 of the housing 2; this configuration of the injector 1 also assures that a control volume loaded with a high pressure is constantly prevailing in the control chamber 4 of the injector 1. The spherical closing element 22 is embodied above the control chamber 4 and is pressed into its sealing seat 21 by an actuatable actuator 23. When the actuator is correspondingly actuated, the spherical closing element 22 unblocks its seat and permits the control volume 4 to flow out of the control chamber 4.

The elements of the control element 3, i.e., the upper control body part 27 and the lower control body part 28, can be produced in a particularly simple manner by numerically controlled processing machines. Because both components are merely turned parts, the provision of a through bore and a throttle element disposed therein according to FIG. 1 can be omitted. The simple turned parts of the upper control body part 27 and the lower control body part 28 should be produced with a high surface quality on their guides and on their flat surfaces that contact each other. In selecting the materials for the upper control body part 27 and lower control body part 28, the circumstance can be taken into account that the lower control body part 28, which is subjected to the pressure of the high-pressure accumulation chamber, should have a greater durability as compared to the upper control body part 27. As a result, the upper control body part 27 can be produced from a less expensive material.

The function of the injector configuration according to FIGS. 1 and 2 will be described below:

When the pressure in the control chamber 4 is relieved, a control volume that is continually prevailing in this chamber and flows in by way of the respective inlet throttle elements 6, flows out by way of the outlet-side throttle 19. After passing through the throttle 19 provided on the outlet side, the control volume travels into a hollow chamber 20 and flows against the spherical closing element 22 on the outlet side, and back into a fuel reservoir in the motor vehicle. through relief of the control chamber 4 pressure, the end face 5 embodied on the one-piece control element 3 or on the upper control body part 27 moves into the control chamber 4. In this manner, the seat diameter 11 is moved out of the seat face 12 of the housing 2 in the lower region of the one-piece control element 3. In the configuration according to FIG. 2, the lower valve control element 28 performing an identically oriented upward motion in relation to the upper valve body 27 moves out of its seat and unblocks the high-pressure accumulation chamber inlet 13. In this manner, the extremely highly pressurized fuel can travel into the nozzle inlet 15 to the injection nozzle after passing the valve chamber 25 by way of a bore 17. The high prevailing pressure in the nozzle inlet 15 prevails at the injection nozzle and also over the entire nozzle inlet 15.

On the downstream side, the covering of the leakage oil control groove (29) with the control surface 8 is assured as long as the lower transverse bore 17 is connected to the high-pressure accumulation chamber inlet 13. When the actuator is actuated in the operative direction 23, the spherical sealing element 22 is pressed into its sealing seat 21 by means of the pressure bolt 24 so that a high pressure builds up in the control chamber 4. As a result, the control surface 5 of the one-piece control element 3 or the upper valve body 27 and thus the lower valve body 28 also travels back into its seat. The seat diameter 11 rests against the seat face 12 of the housing 2 of the injector 1 and seals the valve chamber 25 off from the high fuel pressure prevailing in the high-pressure inlet 13.

The closing motion of the control element 3 or the valve bodies 27 and 28 is triggered by the build-up of pressure in the control chamber 4 and supports the high pressure prevailing against the control surface 8 by way of the nozzle inlet 15. Because the control surface 8 on the one-piece control element 3 or on the upper control body part 27 is embodied as larger in diameter than the lower part of the one-piece control element 3 or the lower control body part 28, a closing of the control element 3; 27, 28 on its seat face 12 in the housing 2 of the injector 1 can be attained. At the same time, the pressure relief of the nozzle inlet 15 upon the closing of the valve chamber 25 causes a relief of the injection nozzle by way of the upper transverse bore in the annular leakage oil chamber 10 extending in the housing 2. In order to relieve the pressure, the fuel volume flows out by way of the leakage oil control groove and by way of the transverse bore between the annular chamber 10, and the leakage oil line 18 and flows into the fuel tank of the motor vehicle.

The foregoing relates to preferred exemplary embodiment of the invention, it being understood that other variants and embodiments thereof are possible within the spirit and scope of the invention, the latter being defined by the appended claims.

I claim:

1. In an injector including a valve chamber (25) contained in an injector housing (2), which valve chamber can be loaded by way of a high-pressure accumulation chamber inlet (13, 26), and loads a nozzle inlet (15) for an injection nozzle by means of a control element (3) that can be moved in the injector housing (2) to relieve the pressure in a control chamber (4), the improvement wherein a control surface (8) is disposed on the control element (3; 27, 28), which is embodied of one part or multiple parts, in the leakage oil chamber region (10, 16) of the nozzle inlet (15), wherein the control surface (8) is embodied at a leakage oil control groove (29) with an axial span (9).

2. The injector according to claim 1, wherein the diameter of the control surface (8) is proportioned as being greater than that of the control element (3) inside the valve chamber (25) encompassing it in the nozzle inlet region.

3. The injector according to claim 1, wherein the control element (3), which is embodied as one piece, is penetrated by a through bore (7) that provides a conduit from high-pressure inlet (13).

4. The injector according to claim 1, wherein an inlet throttle (6) that empties into the control chamber (4) is integrated into the through bore (7).

5. The injector according to claim 1, wherein the control surface (8) can be loaded from an annular leakage oil chamber (10) provided on the housing side that is connected to the nozzle inlet (15) by way of an opening in the leakage oil chamber region (16) and by way of this inlet, can be subjected to high pressure during the closing process of the control element (3; 27, 28).

6. The injector according to claim 1, wherein the housing (2) of the injector (1) comprises a lateral inlet (26) guided parallel to a symmetry line that branches off from the high-pressure connection (14), by way of which the control chamber (4) can be loaded.

7. The injector according to claim 6, wherein the housing (2) of the injector (1) contains a two-piece control element (27, 28).

8. The injector according to claim 7, wherein in the upper control element body (27), the control surface (8) is dimensioned with a diameter that is greater than the diameter of the lower control element (28) in the valve chamber (25).

9. The injector according to claim 7, wherein the upper control body part (27) and the lower control body part (28) rest against each other along flat surfaces inside the housing (2) and have identically oriented vertical motions.

* * * * *